US010694871B1

(12) United States Patent
Vogler et al.

(10) Patent No.: US 10,694,871 B1
(45) Date of Patent: Jun. 30, 2020

(54) ANTI-SWEEP MECHANISM FOR MERCHANDISE DISPLAY HOOK

(71) Applicant: Marketing Impact Limited, Concord (CA)

(72) Inventors: Jay Vogler, Concord (CA); Martin Gil, Concord (CA); Marian Kosara, Concord (CA)

(73) Assignee: Marketing Impact Limited, Concord (CA)

( * ) Notice: Subject to any disclaimer, the term of this patent is extended or adjusted under 35 U.S.C. 154(b) by 0 days.

(21) Appl. No.: 16/277,694

(22) Filed: Feb. 15, 2019

(51) Int. Cl.
*A47F 5/08* (2006.01)
*A47F 5/00* (2006.01)

(52) U.S. Cl.
CPC ..... *A47F 5/0861* (2013.01); *A47F 5/0006* (2013.01)

(58) Field of Classification Search
CPC ..... A47F 5/0861; A47F 5/0006
See application file for complete search history.

(56) References Cited

U.S. PATENT DOCUMENTS 1,033,915 A * 7/1912 McDonald ..... B42F 13/12 211/57.1
4,869,376 A 9/1989 Valiulis et al.
5,275,027 A * 1/1994 Eklof ..... A47F 5/0861 211/4
6,622,979 B2 9/2003 Valiulis
6,957,555 B1 * 10/2005 Nagel ..... A47F 5/0861 211/57.1
7,197,902 B1 * 4/2007 Barkdoll ..... A47F 5/0861 211/57.1
7,392,673 B2 * 7/2008 Fawcett ..... A47F 5/0861 211/7
7,484,628 B2 2/2009 Schneider
7,566,037 B2 7/2009 Vogler
8,534,469 B2 9/2013 Northrup, Jr. et al.
8,739,981 B2 * 6/2014 Piskor ..... A47F 5/0861 211/59.1
9,289,080 B1 * 3/2016 Mchatet ..... E05B 15/00
9,386,864 B2 * 7/2016 Pongrac ..... A47F 5/0861
(Continued)

*Primary Examiner* — Ko H Chan
(74) *Attorney, Agent, or Firm* — Ridout & Maybee LLP

(57) ABSTRACT

An anti-sweep mechanism for controlling removal of merchandise items from a forward dispensing end of a merchandise display rod, the anti-sweep mechanism comprising a body having a first blocking portion and a second blocking portion, the body being rotatable between a first position and a second position wherein when the body is in the first position, the first blocking portion blocks forward movement towards the forward dispending end of merchandise items located on the merchandise display rod behind a first blocking location, and the second blocking portion is rotated away from the merchandise display rod to not interfere with movement of merchandise items along the merchandise display rod; and when the body is in the second position, the first blocking portion is rotated away from the merchandise display rod to not interfere with movement of merchandise items along the merchandise display rod, and the second blocking portion blocks forward movement of merchandize items located on the merchandise display rod behind a second blocking location that is spaced behind the first blocking location.

20 Claims, 6 Drawing Sheets

(56) References Cited

U.S. PATENT DOCUMENTS

| | | | | |
|---|---|---|---|---|
| 2008/0309489 | A1* | 12/2008 | Hachmann | A47F 5/0861 340/568.8 |
| 2009/0095695 | A1* | 4/2009 | Moock | A47F 5/0861 211/57.1 |
| 2017/0238724 | A1 | 8/2017 | Berglund et al. | |

* cited by examiner

ANTI-SWEEP MECHANISM FOR MERCHANDISE DISPLAY HOOK

FIELD

This disclosure invention relates generally to a merchandise display hook for displaying items of merchandise on a display fixture.

BACKGROUND

Merchandise display hooks are used extensively to display items of merchandise, for example, in a retail store. Typically, a plurality of display hooks are each individually mounted on a generally vertical display fixture, such as a conventional slat wall or slot wall, wire grid, bar rack or pegboard. The use of multiple display hooks on the display fixture provides an aesthetic and organized display area that allows prospective customers to view the items of merchandise without assistance from sales personnel.

In the case of higher cost merchandise items, such as personal care items like razor blade cartridges, merchandise display solutions must balance the benefits of convenient access that attracts prospective customers against the theft opportunities presented by that access. In the case of a conventional merchandise display hook in which merchandise items are suspended from a straight merchandise rod, a common theft scenario is for a thief to collectively slide multiple merchandise items forward off of the dispensing end of the merchandise rod (commonly referred to as a "sweep") and into a portable carrying receptacle such as a booster bag.

In this regard, anti-sweep mechanisms have been developed to impede the removal of multiple merchandise items from a merchandise display hook within a short time period. However, these systems typically suffer from one or more of the following deficiencies: they require investment in customized merchandise display systems that may be expensive or bulky; they lack durability over time; they make it excessively inconvenient for prospective customers to view or remove merchandise items; and/or they do not sufficiently impede sweeping of multiple merchandise items. Accordingly, there is a need for an anti-sweep mechanism for a merchandise display hook that may address one or more of these deficiencies or other shortcomings of known display solutions.

SUMMARY

According to a first example aspect, an anti-sweep mechanism for controlling removal of merchandise items from a forward dispensing end of a merchandise display rod is dislcosed. The anti-sweep mechanism comprise a body having a first blocking portion and a second blocking portion, the body being configured whereby when mounted to a support member adjacent the merchandise display rod the body is rotatable between a first position and a second position. When the body is in the first position, the first blocking portion blocks forward movement towards the forward dispending end of merchandise items located on the merchandise display rod behind a first blocking location, and the second blocking portion is rotated away from the merchandise display rod to not interfere with movement of merchandise items along the merchandise display rod. When the body is in the second position, the first blocking portion is rotated away from the merchandise display rod to not interfere with movement of merchandise items along the merchandise display rod, and the second blocking portion blocks forward movement of merchandize items located on the merchandise display rod behind a second blocking location that is spaced behind the first blocking location.

According to another aspect, a merchandise display hook system is disclosed that includes a merchandise display rod having a forward dispensing end for dispensing merchandise items; a support rod; and an anti-sweep mechanism for preventing sweeping of merchandise items from the dispensing end of the merchandise display rod. The merchandise display rod and support rod is mountable to a display fixture with the support rod extending substantially parallel to and spaced a predetermined distance from the merchandise display rod. The anti-sweep mechanism includes a body with a first blocking portion and a second blocking portion, the body being mounted to the support rod and rotatable about the support rod between a first position and a second position, wherein: the first blocking portion is configured to: (i) block forward movement of merchandise items suspended from the merchandise display rod behind a first blocking location when the body is in the first position or within a first angular range of the first position, and (ii) not block movement of merchandise items along the merchandise display rod when the body is in the second position or within a second angular range of the second position; the second blocking portion is configured to: (i) block forward movement of merchandise items suspended from the merchandise display rod behind a second blocking location that is located further from the dispensing end than the first blocking location, when the body is in the second position or within the second angular range, and (ii) not block movement of merchandise items along the merchandise display rod when the body is in the first position or within the first angular range; the body being configured so that one or both of the first blocking portion and the second blocking portion will, when the body is rotated within an angular range that is between the first angular range and the second angular range, block movement of merchandise items along the merchandise display rod towards the dispensing end.

According to another aspect is an anti-sweep mechanism for controlling removal of merchandise items from a merchandise display rod when the anti-sweep mechanism is mounted adjacent the merchandise display rod. The anti-sweep mechanism comprises: a body configured to be rotatable about an axis between a first position and a second position. The body includes a central portion through which the axis extends; a first arm extending in a first radial direction from the central portion and forming a first blocking member; and a second arm extending in a second radial direction from the central portion and forming a second blocking member. The second arm is axially spaced apart on the central portion from the first arm. The body is configured so that, when the anti-sweep mechanism is mounted adjacent the merchandise display rod: the first blocking portion will: (i) when the body is in the first position, block forward movement of merchandise items located on the merchandise display rod behind a first blocking location, and (ii) when the body is in the second position, allow a merchandise item located forward of the first blocking location to be removed from a dispensing end of the merchandise display rod; and the second blocking will: (ii) when the body is in the second position, block forward movement of merchandise items located on the merchandise display rod behind a second blocking location that is located behind the first blocking location, and (ii) when the body is in the first position, allow a merchandise item to be moved along the merchandise display rod from behind the second blocking location to a position forward of the second blocking location.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

Figure 1:
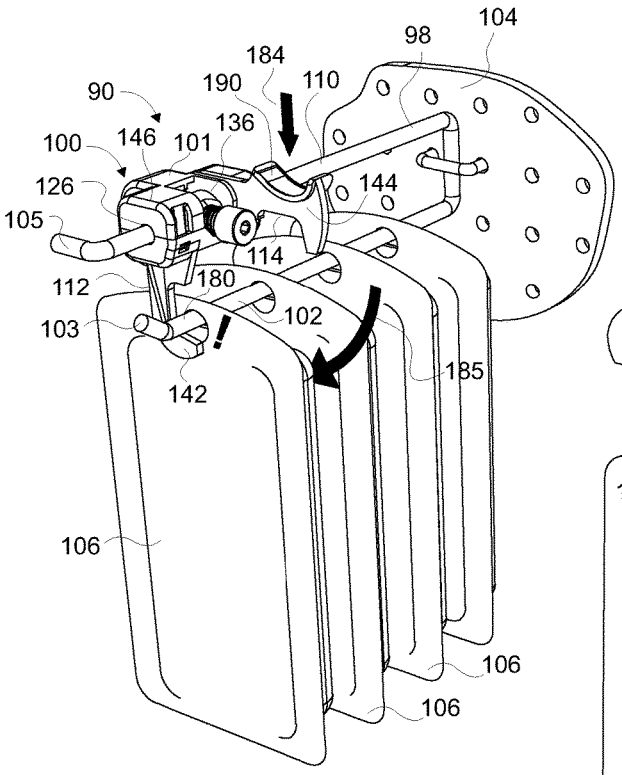
FIG. 1 is a perspective view showing a merchandise display hook system that incorporates an anti-sweep mechanism located in a first position, according to example embodiments.

The accompanying Figures illustrate one or more embodiments of a merchandise display hook system 90 for mounting on a display fixture 104, such as a pegboard, slat wall or slot wall, wire grid or bar rack. In the illustrated examples, the display fixture 104 shown herein is a conventional pegboard type display fixture commonly referred to as "pegboard." The display hook system 90 comprises a display hook 98 and an anti-sweep mechanism 100 constructed in accordance with embodiments described below. The anti-sweep mechanism 100 is operable for increasing the amount of time required to remove a merchandise item 106 from the display hook 98, while still permitting a prospective customer to access and remove a merchandise item 106. Each merchandise item 106 is suspended from the display hook 98. Merchandise items 106 may include products in supplier packaging directly suspended from the display hook 98, as well as products secured within a safer or box that is suspended from the display hook 98. In example embodiments, the display hook 98 may be a conventional peg style display hook, also referred to as a "peg hook", having a mounting structure suitable for mounting on the pegboard.

FIGS. 1 through 4 show an example embodiment of a display hook system 90 that include an anti-sweep mechanism 100 and a display hook 98 configured to be mounted onto a display fixture 104, such as pegboard. In the illustrated embodiments, the display hook 98 is an over/under parallel rod display hook that includes a lower merchandise display rod 102 and an upper support rod 110 that is spaced apart from and extends substantially parallel to the merchandise display rod 102. As indicated in the Figures the merchandise display rod 102 and support rod 110 may be joined at their respective pegboard mounting ends. A pegboard engagement interface 111 may be provided at the joined ends for securing the display hook 98 to display fixture 104. In some examples, a back plate may be secured to the back of the display fixture 104 to secure the pegboard engagement interface 111 in place and prevent unauthorized removal of the display hook 98 from the display fixture 104.

Merchandise items 106 can be suspended from the merchandise display rod 102 and pulled forward to be removed from a dispensing end 103 of the display rod 102. Dispensing end 103 may have an upward bend. The forward end of the support rod 110 may terminate with a lateral arm section 105, which may for example be used to support a display card or tag (not shown) that presents information about the suspended merchandise items 106. Although a parallel rod pegboard display hook 98 is shown and described herein for purposes of illustration and explanation, it will be readily apparent to those skilled in the art that the devices and systems described herein are applicable to other types and configurations of merchandise display hooks configured with suitable mounting structure for mounting on a different type of display fixture, such as, for example, slat wall or slot wall, wire grid, or bar rack.

In the illustrated examples the display rod 102 and support rod 110 have a circular cross-sectional area, however one or both could alternatively have other cross-sectional profile shapes including for example oval, elliptical, and polygonal (for example square, rectangular or U-shaped), among other things. In some examples the upper support rod 110 may be replaced with an alternative support member structure configured to support the anti-sweep mechanism 90 in spaced relation to the display rod 102. In one non-limiting example embodiment, anti-sweep mechanism 100 is configured to be mounted on a support rod 110 having a diameter of approximately ¼ inch, however the anti-sweep mechanism 100 can be configured for a wide range of support rod and display rod diameters and configurations.

Figure 3:
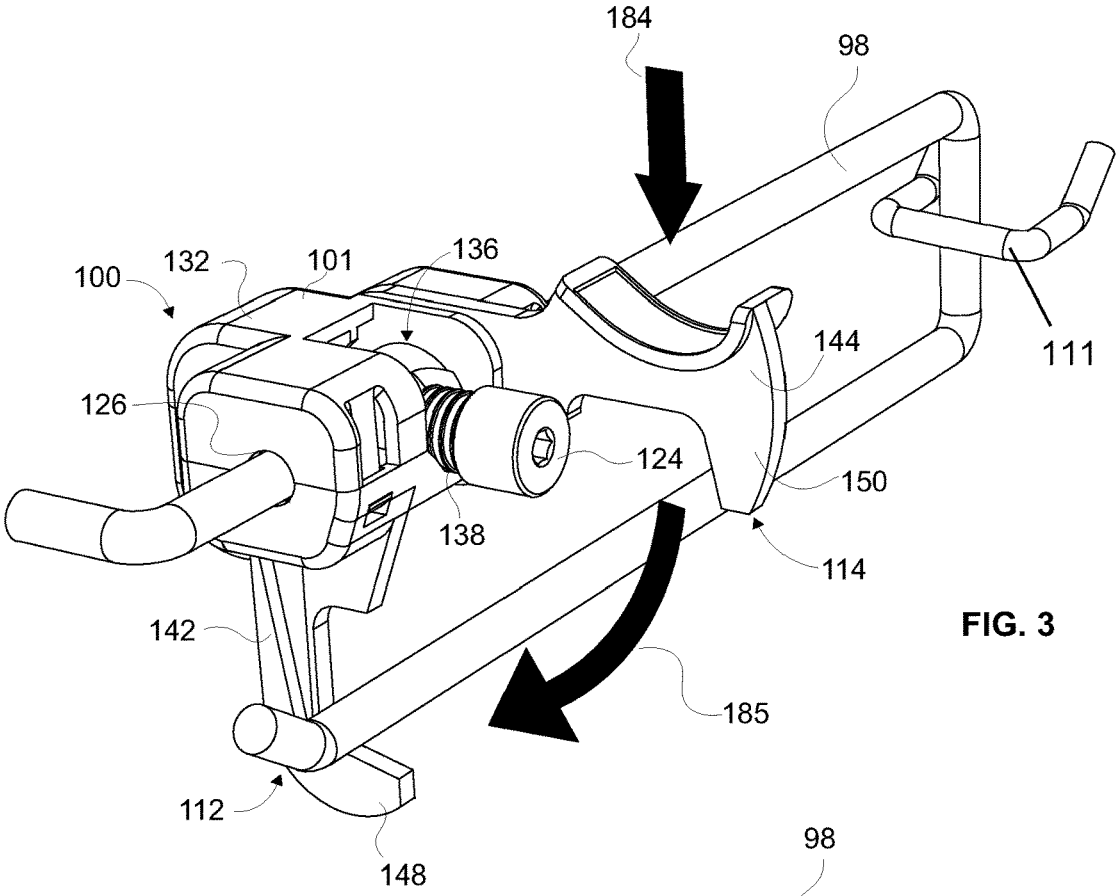
FIG. 3 is a further perspective view showing the merchandise display hook system of FIG. 1 with the anti-sweep mechanism in the first position.

In example embodiments, the anti-sweep mechanism 100 is configured to control removal of merchandise items 106 from the forward dispensing end 103 of merchandise display rod 102. In this regard, the anti-sweep mechanism 100 includes a body 101 having a first blocking portion 112 and a second blocking portion 114. The body 101 is configured to be mounted to a support member such as support rod 110 and rotatable between a first position and a second position. FIGS. 1 and 3 show the body 101 in its first position. As illustrated, when the body 101 is in the first position, the first blocking portion 112 blocks forward movement of merchandise items 106 along the display rod 102 towards the forward dispending end 103. In particular, first blocking portion 112 blocks forward movement of merchandise items 106 located on the merchandise display rod 102 behind a first blocking location 180. When the body 101 is in the first position, the second blocking portion 114 is rotated away from the merchandise display rod 102 sufficiently to not interfere with movement of merchandise items 106 along the merchandise display rod.

Figure 2:
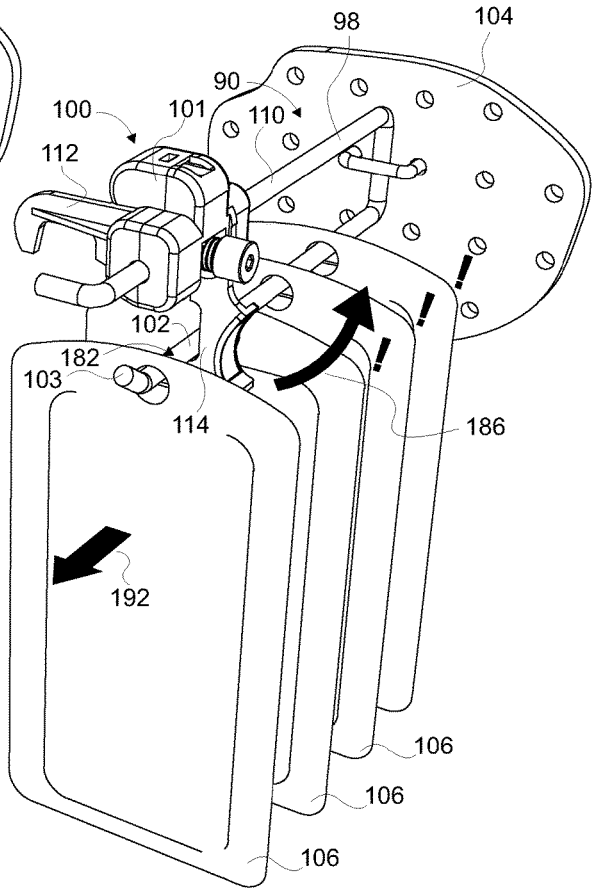
FIG. 2 is a perspective view showing the merchandise display hook system of FIG. 1 with the anti-sweep mechanism located in a second position.
Figure 4:
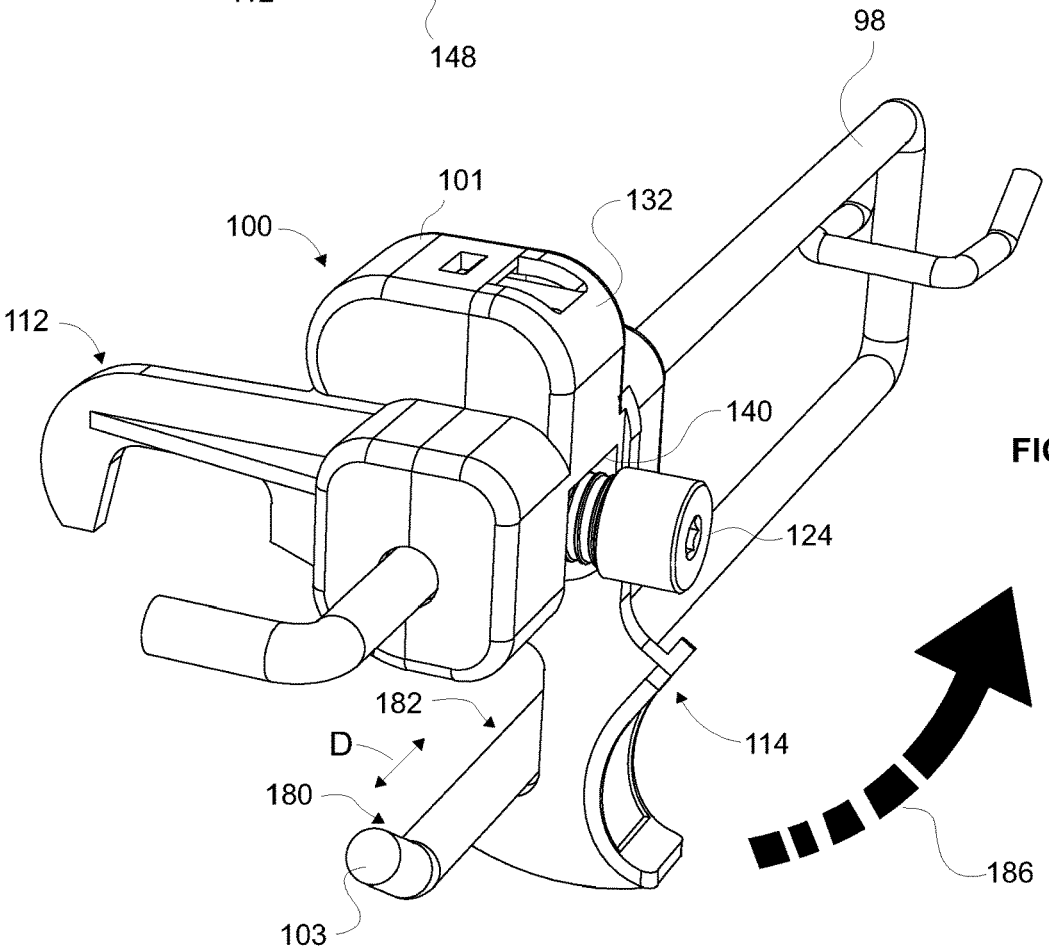
FIG. 4 is a further perspective view showing the merchandise display hook system of FIG. 1 with the anti-sweep mechanism in the second position.

FIGS. 2 and 4 show the body 101 rotated into its second position. As illustrated, when the body 101 is in the second position, the first blocking portion 112 is rotated away from the merchandise display rod 102 to not interfere with movement of merchandise items 106 along the merchandise display rod 102. However, the second blocking portion 112 blocks forward movement of any merchandize items 106 that are located on the merchandise display rod 102 behind a second blocking location 182 that is spaced a distance "D" (see FIG. 4) behind the first blocking location 180.

As will be described in greater detail below, in example embodiments the body 101 of the anti-sweep mechanism 100 is biased by a spring or other biasing mechanism into the first position and can be manually rotated from the first position to the second position by an external rotational force (represented by arrow 184 in FIGS. 1 and 3). Once the external force 184 is released, the body 101 automatically rotates back to the first position, as represented by arrow 186 in FIG. 4.

Figure 5:
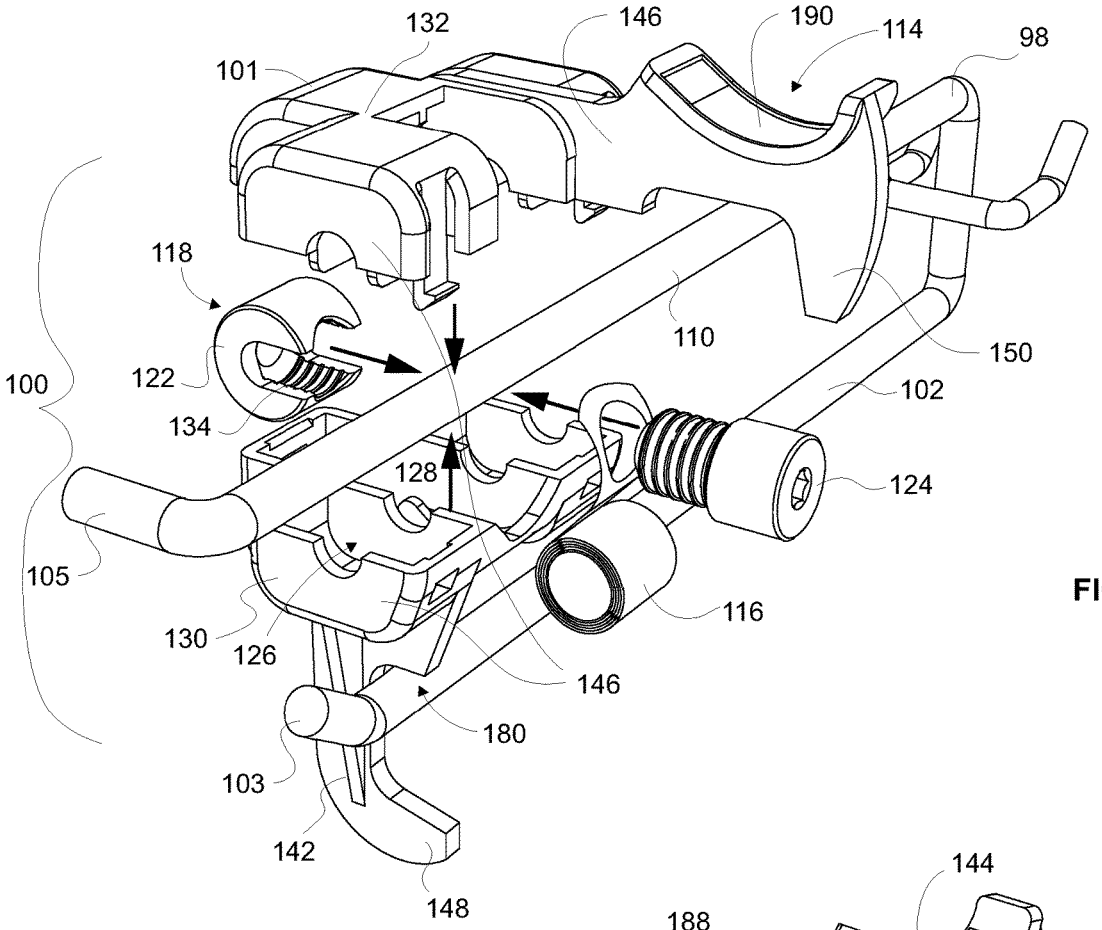
FIG. 5 is a perspective view showing the merchandise display hook system of FIG. 1 with an exploded view of the anti-sweep mechanism.
Figure 6:
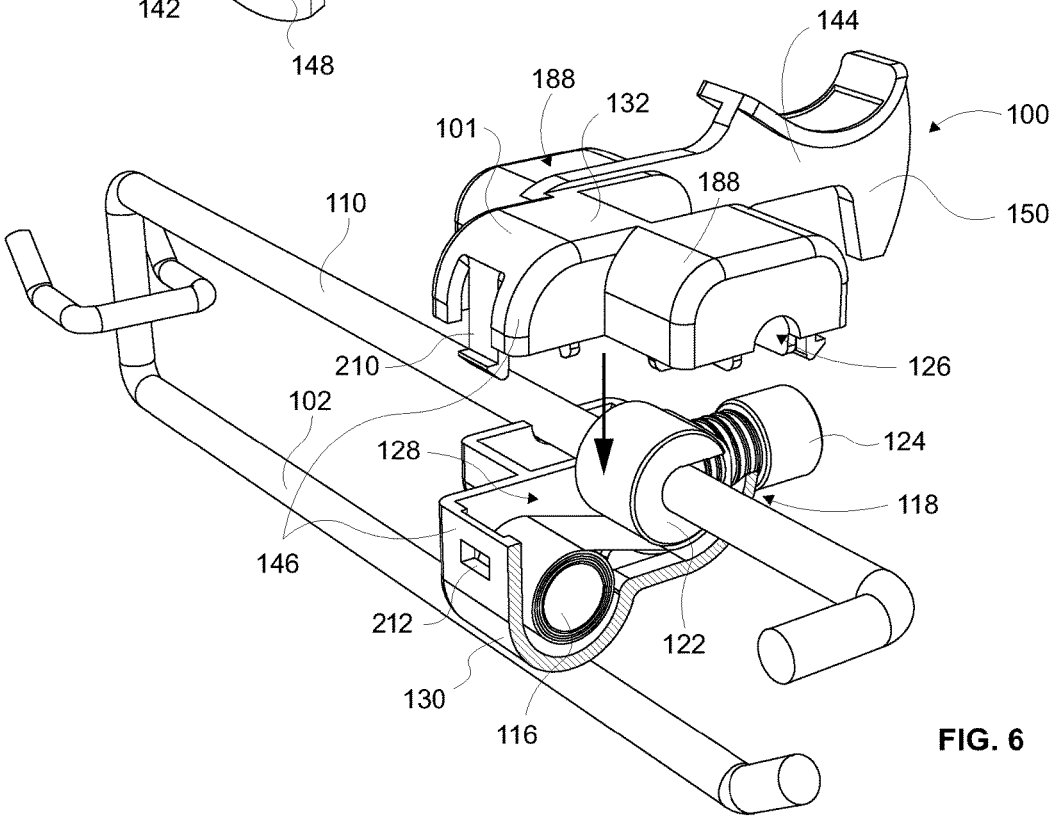
FIG. 6 is a perspective view showing the merchandise display hook system of FIG. 1 with an exploded, partial-sectional view of the anti-sweep mechanism.

A possible configuration of the anti-sweep mechanism 100 according to an example embodiment will now be provided in greater detail with reference to FIGS. 5 and 6. In example embodiments, the body 101 includes a central portion 146 that defines an axial aperture 126 configured to receive the support member 110. The first blocking portion 112 of the body 101 is formed by a first arm 142 that extends in a first radial direction from the central portion 146. The second blocking portion 114 of the body 101 is formed by a second arm 144 that is axially spaced from the first arm 142 and extends in a different, second radial direction from the central portion 146. In the illustrated example, the first arm 142 and second arm 144 are angularly separated from each other by approximately ninety degrees and are axially separated by a distance that defines the distance "D" between the first merchandise blocking location 180 and second merchandise blocking location 182 noted above.

In the illustrated embodiment, the body 101 is formed from rigid plastic (for example a polycarbonate or an ABS mateial), although other rigid materials such as steel or steel alloys could be used. In example embodiments, the body 101 includes two joinable sections, namely a first body section 130, which includes first arm 112, and a second body section 132, which includes second arm 114. The first and second body sections 130, 132 define respective portions of axial aperture 126 and are configured to be cooperatively secured together to mount the body 101 on the support member 110. In the illustrated embodiment, the first body section 130 and the second body section 132 include cooperating tabs 210 and tab anchors 212 for securing the first body section 130 and second body section 132 together, however other securing means could be used such as a combination of through-holes, threaded holes and screws.

In the illustrated embodiment, the body 101 includes axial strengthening structures 188 provided on the axial sides of the central portion 146 to strengthen the body 101. As shown, the axial aperture 126 passes through the central portion 146 and the axial strengthening structures 188, with four openings being provided through wall structures of the body 101 to provide axial aperture 126.

In example embodiments, the first body section 130 and the second body section 132 collectively define an internal cavity 128 within the central portion 146 of the body 101. The internal cavity 128 is used to house an anchor mechanism 118 and the aforementioned biasing mechanism, which in the illustrated embodiment takes the form of a constant force flat coil torsion spring 116. In example embodiments, the anchor mechanism 118 is configured to secure the axial location of the body 101 relative to the support rod 110 and set the rotational positions of body 101 relative to support rod 110 and display rod 102.

In an example embodiment, the anchor mechanism 118 comprises a nut 122 having a cylindrical profile to facilitate rotation of the body 101. The nut 122 defines slot 134 for receiving a portion of the support rod 110, and a headed set screw 124 configured to engage threads of the nut 122 to enable a forward end of the set screw 124 and an opposed side of the nut 122 to compressively engage opposite sides of the support member 110 and thereby secure the anchor mechanism 118 in at a desired axial location and angular position on the support rod 110. In example embodiments, the exposed end of the headed set screw 124 defines a keyed tool receptacle that requires a correspondingly keyed tool to loosen and tighten the set screw 124.

Once the anchor member 118 is secured to the support rod 110 and the body 101 is mounted on the support rod 118 with the anchor member 118 received in internal cavity 128, opposed axial walls of body 101 that define the internal cavity 128 respectively contact opposite ends of the anchor member 118 to restrain axial movement of the body 101 along the support rod 110.

In an example embodiment, the body 101 defines a radial opening 136 that communicates with the internal cavity 126 and through which a portion of the set screw 124 extends, enabling the axial location and rotational position of the anchor member 118 on support rod 110 to be adjusted without removing the body 101 from the support member. Furthermore, in example embodiments, the radial opening 136 is a slot bounded by a first stop surface 138 for engaging the set screw 124 to prevent the body 101 from rotating in a first direction beyond the first position and a second stop surface 140 for engaging the set screw 124 to prevent the body 101 from rotating beyond the second position in an opposite rotational direction. In an example embodiment, the first stope surface 138 and second stop surface extend at substantially 90 degrees relative to each other.

In the illustrated embodiment, the flat coil spring 116 has a first outer end secured relative to the support rod 110 by the anchor mechanism 118, with the remaining coiled portion of the spring 116 being received within a portion of the internal cavity 128 that is axially off-set from the support rod 110. In one example, the secured end of the spring 116 includes an opening that has a smaller diameter than the head of headed set screw 124. A portion of the shaft of the headed set screw 124 passes through the spring end opening to anchor the spring end to the support member 110 while the portion of the spring 116 in internal cavity 128 biasingly engages the body 101. In alternative embodiments different spring configurations may be used to provide biasing, as well as different biasing mechanisms, for example gravity-based biasing based on unequal weighting of the blocking portions 112, 114.

In example embodiments, the first arm 144 may have a hook-like profile and includes a section 148 configured to extend under the merchandise display rod 102 when the body 101 is in the first position, and the second arm 146 may also have a hook-like profile and includes a section 150 configured to extend under the merchandise display rod 102 when the body 101 is in the second position. In example embodiments, a portion of the first arm 144 may contact or engage the merchandise display rod 102 at the first blocking location 180 when the body 101 is in the first position, and a portion of the second arm 146 may contact or engage the merchandise display rod 102 at the second blocking location 182 when the body 101 is in the second position.

The dimensions and angular and axial separation of the elements of the body 101 can be a configured based on the dimensions of the merchandise items that are to be secured, as well as the spacing between the support rod 110 and the display rod 102. By way of non-limiting example, in some example embodiments, an axial spacing of the first and second blocking portions 112, 114 is a dimension between approximately ½ inch and 2 inches such that the second blocking location 182 is a dimension between approximately ½ inch and 2 inches further from the dispensing end 103 than the first blocking location 180, and in some example embodiments the first and second blocking portions 112, 114 are each configured to radially extend to a maximum of between approximately 1.5 and 3 inches from the support rod 110.

Now that a description of the physical configuration of anti-sweep mechanism 100 has been provided, a summary of its operation will be described. The terms clockwise and counter clockwise will be used to describe the rotational direction of the body 101 of anti-sweep mechanism as it moves between first and second positions, although it will be appreciated that the rotational directions can be reversed relative to those in the illustrated examples. Referring to FIGS. 1 and 2, anti-sweep mechanism 100 may provide metered control of the removal of merchandise items 106 from the display hook 98 as follows. As shown in FIG. 1, the body 101 is in its first position and suspended merchandise items 106 are all located behind the first blocking location 160. The first blocking portion 112 of the body 101 is located in front of the merchandise items 106 and blocks their forward movement towards the dispensing end 103 of display hook 102. The second blocking portion 114 is positioned so it is out of any contact with the merchandise items 106, allowing the leading merchandise items 106 to be moved into a region between the first blocking location 180 and the second blocking location 182. In example embodiments, the axial spacing between first blocking portion 112 and second blocking portion 114 is configured so that there is generally only room for one merchandise item 106 to be located between the first blocking location 180 and the second blocking location 182 at a given time.

As indicated by arrow 184 in FIG. 1, when a prospective customer applies a rotational force (e.g. clockwise force in the illustrated example) the body 101 rotates clockwise (indicated by arrow 185) approximately 90 degrees to the second position, shown in FIG. 2. In example embodiments, a widened concave region 190 is formed on an upper surface of the second arm 144 to provide a user interface surface for the rotational force applying finger of the prospective customer. Aside from providing a comfortable pressing surface for the prospective customer, widened concave region 190 provides a visual indication to the prospective customer of how to operate the merchandise dispensing mechanism 100.

As shown in FIG. 2, when the body 101 is in the second position, the second blocking member 114 is rotated into a position whereby it blocks forward movement of any merchandise items located behind the second blocking location 182. At the same time, the first blocking member 112 is rotated clockwise out of any contact with the merchandise items 106, allowing the leading merchandise item 106 that was located forward of the second blocking location 182 to be slid forward along the display rod 102 and removed from the dispensing end 103, as indicated by arrow 192 in FIG. 2.

The body 101 remains in the second position only while external rotational force 184 is applied. When the prospective customer stops applying force, the biasing force applied by spring 116 causes the body 101 to rotate counterclockwise, indicated by arrow 186 in FIG. 2, and return to its first position, shown in FIG. 1. The process described above can be reversed to load merchandise items 106 onto the display rod 102

It will thus be appreciated that the anti-sweep mechanism 100 can be used to control the dispensing of merchandise items 106 from the display rod 102 and prevent sweeping of large numbers of merchandise items 106 off of the display rod 102. In at least some example embodiments, the anti-sweep mechanism 100 can be mounted onto a conventional dual-rod merchandise display hook, which may improve convenience and reduce cost for a retailer who already has double rod-display hooks. In example embodiments, the anti-sweep mechanism 100 can be conveniently retrofitted on an existing dual-rod display hook without removing any merchandise items that are already suspended from the hook.

In some example embodiments, the small number of parts required for anti-sweep mechanism 100 may provide reliability and endurance over multiple use cycles.

Figure 7A:
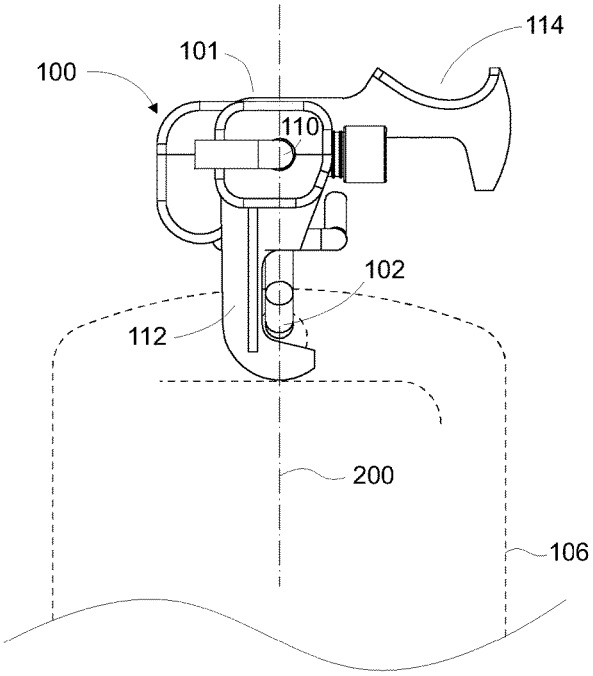
FIG. 7A is a schematic end view showing an anti-sweep mechanism in a first position, according to an example embodiment.
Figure 7B:
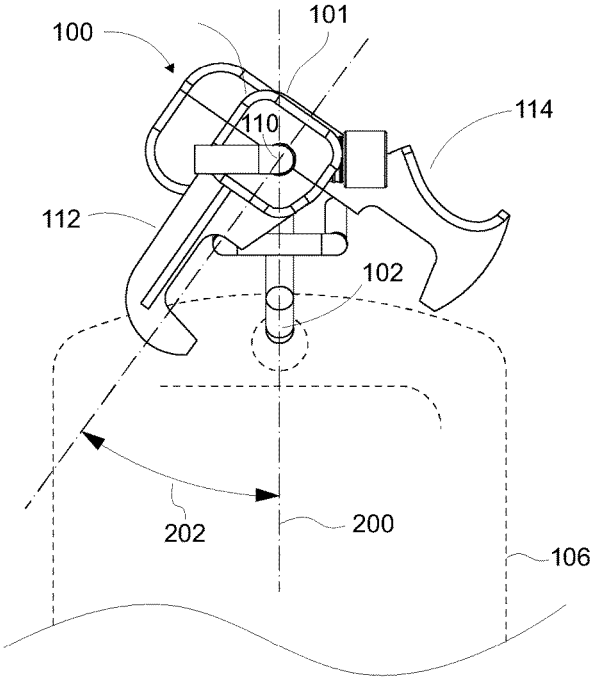
FIG. 7B is a schematic end view showing the anti-sweep mechanism of FIG. 7A within a first angular range of the first position.

FIGS. 7A through 9 are schematic views presented to illustrate that in at least some examples the first position corresponds to a maximum rotation (e.g. counterclockwise rotation) of the body 101 in a first angular range and the second position corresponds to a maximum rotation (e.g. clockwise rotation) of the body 101 in a second angular range. In this regard FIG. 7A is a schematic end view showing anti-sweep mechanism 100 with body 101 in the first position, and FIG. 7B is a schematic end view showing the anti-sweep mechanism 100 within a first angular range 202 of the first position. As shown in FIGS. 7A and 7B, the first blocking portion 112 is configured to block forward movement of merchandise items 106 behind the first blocking location 180 when the body 101 is in the first position (illustrated by dashed line 200) as well as when the body 101 is rotated within a first angular range 202 of the first position, while at the same time the second blocking portion 114 does not block forward movement of the merchandise items 106 when the body 101 is rotated within the first angular range 202.

Figure 8A:
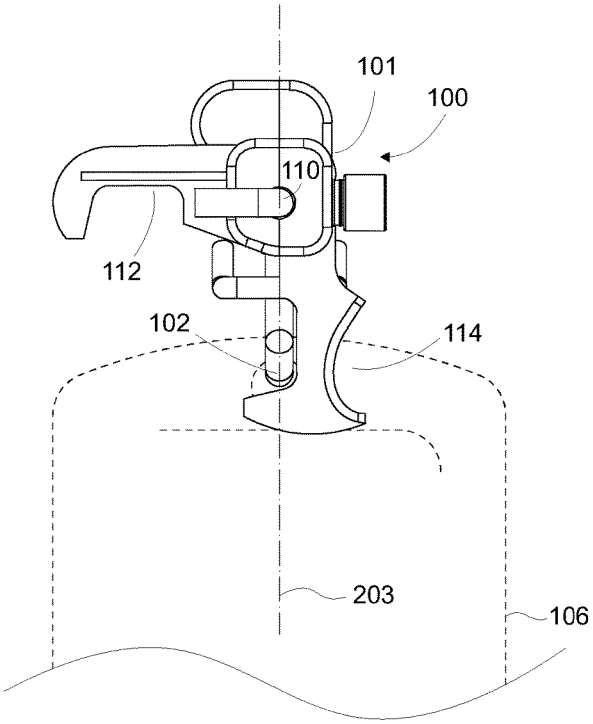
FIG. 8A is a schematic end view showing the anti-sweep mechanism of FIG. 7A in a second position.
Figure 8B:
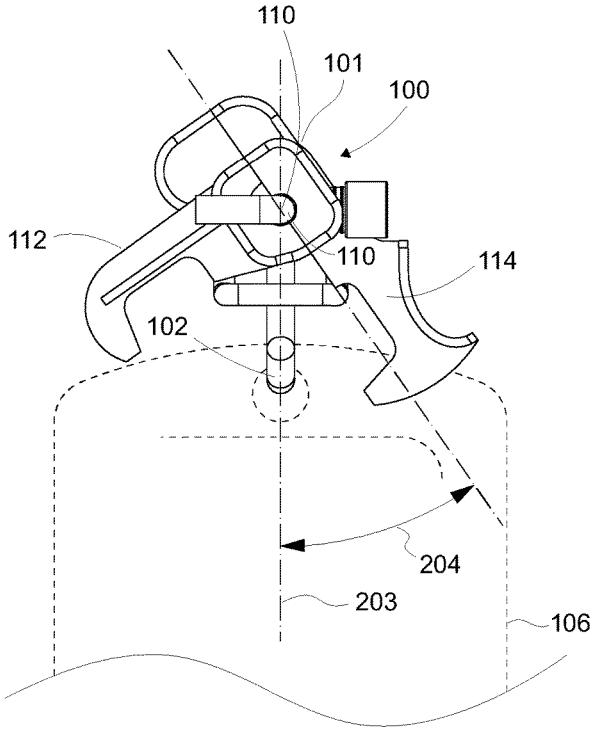
FIG. 8B is a schematic end view showing the anti-sweep mechanism of FIG. 7A within a second angular range of the second position.

Similarly, FIG. 8A is a schematic end view showing the anti-sweep mechanism 100 with body 101 in the second position, and FIG. 8B is a schematic end view showing the anti-sweep mechanism 100 within a second angular range 204 of the first position. As shown in FIGS. 8A and 8B, the second blocking portion 114 is configured to block forward movement of merchandise items 106 behind the second blocking location 182 when the body 101 is in the second position (illustrated by dashed line 203) as well as when the body 101 is rotated within a second angular range 204 of the first position, while at the same time the first blocking portion 112 does not block forward movement of the merchandise items 106 when the body 101 is rotated within the second angular range 202.

Figure 9:
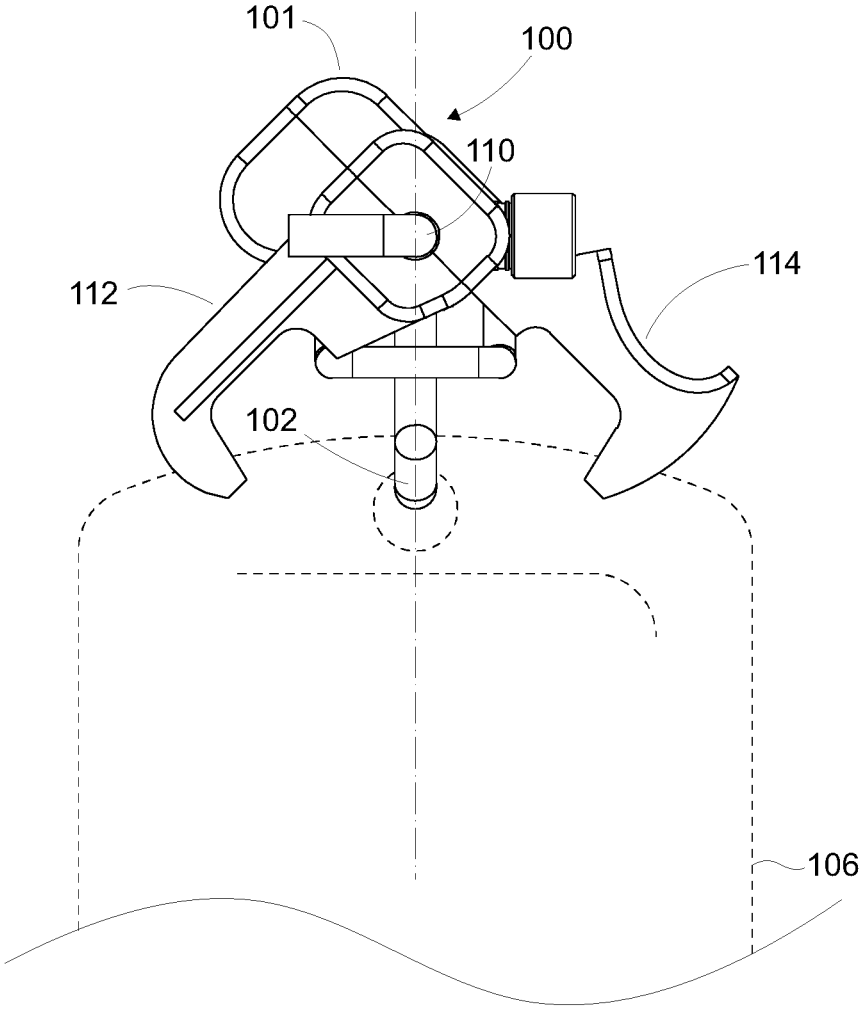
FIG. 9 is a schematic end view showing the anti-sweep mechanism of FIG. 7A within an intermediate angular range.

As illustrated in FIG. 9, when the body 101 rotates through an intermediate angular range between the first and second angular ranges 202, 204, both the first and second blocking portions 112, 114 are positioned to block movement of merchandise items 106 along the merchandise display rod 102 towards the dispensing end 103.

Figure 10A:
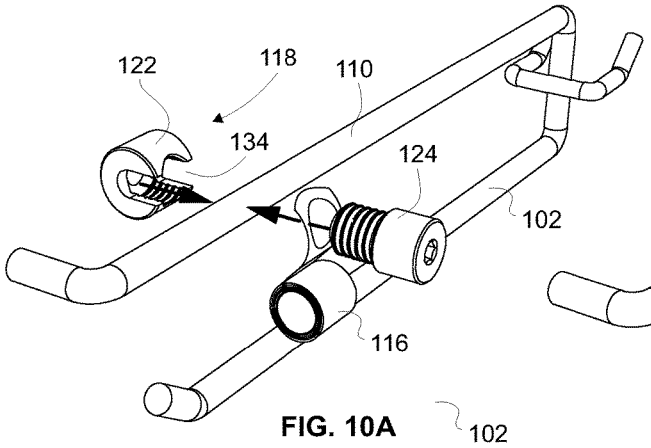
FIG. 10A to 10F are perspective views illustrating a method of mounting an anti-sweep mechanism to a display hook according to an example embodiment.
Figure 10B:
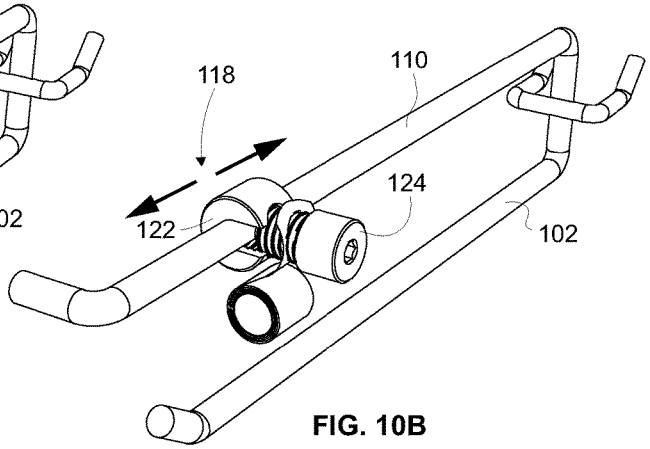
Figure 10C:
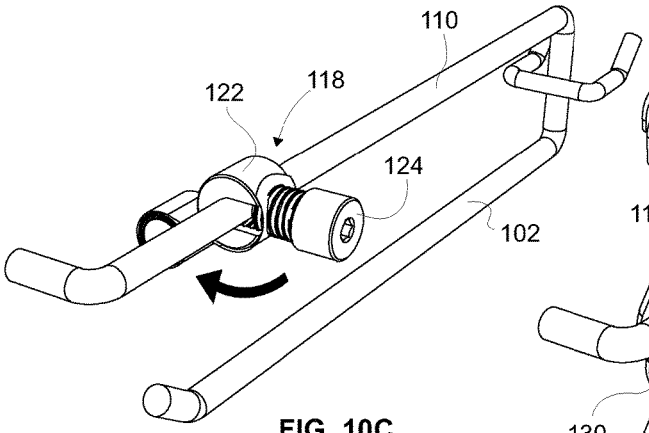
Figure 10D:
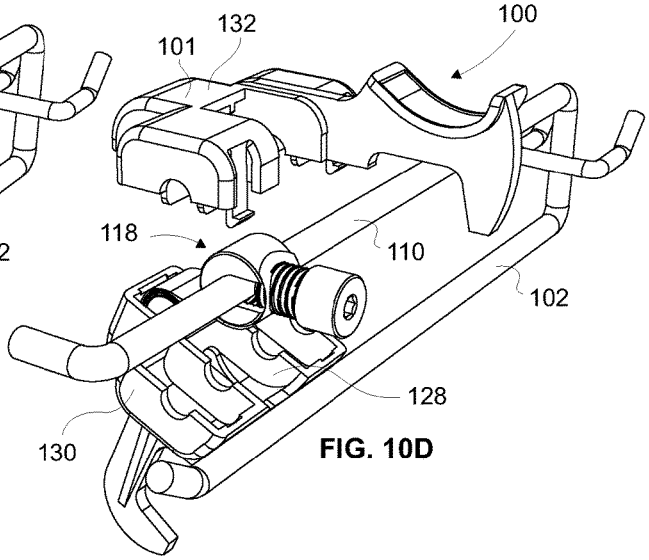

A method for mounting the anti-sweep mechanism 100 to a support member such as support rod 110 will now be described with respect to FIGS. 10A to 10F, according to an example embodiment. First, the anchor mechanism 118 is secured to the display rod in the manner shown in FIGS. 10A to 10C. In particular, as shown in FIG. 10A, cylindrical nut 122 is slid radially onto support rod 110 so that a portion of the support rod 110 is received within the nut slot 134. A forward end of set screw 124 is threaded through a hole in end of flat coil spring 116 and into threaded engagement with the nut 122. Tightening of the set screw 124 causes the nut 122 and set screw 124 to opposingly engage opposite surfaces of the support rod 110. As illustrated in FIG. 1013, the location of anchor mechanism 118 on support rod 110 can be axially adjusted to a desired location prior to a full tightening of the screw 124. Similarly, as illustrated in FIG. 10D, the rotational or angular position of anchor mechanism 118 on support rod 110 can be rotated to a desired position prior to a full tightening of the screw 124.

Figure 10E:
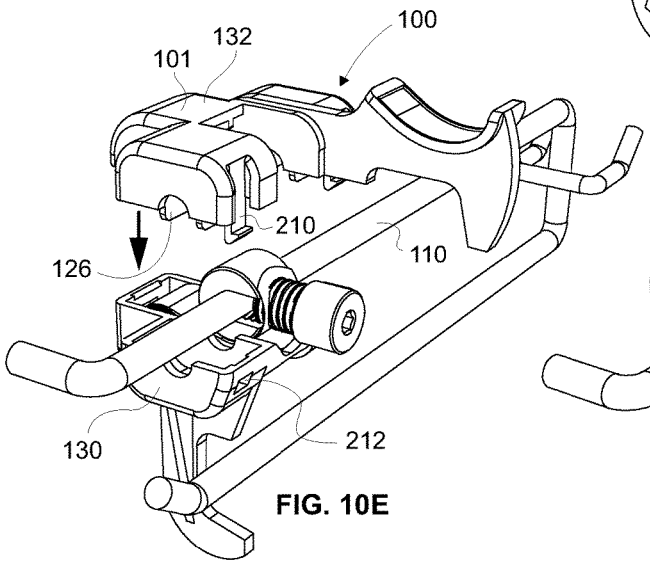
Figure 10F:
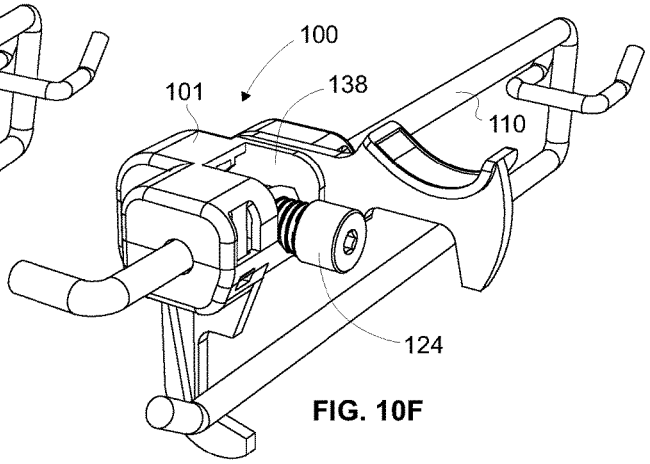

Once the anchor mechanism 118 is mounted on support rod 110, the body 101 can be mounted on the support rod 110. As illustrated in FIGS. 10D and 10E, first and second body sections 130, 132 are brought together from opposite sides of support rod 110 to position the anchor mechanism 118 and spring 116 within respective regions of internal cavity 128 and align the semi-circles that define axial aperture 126 with the support rod 110. The cooperating tabs 210 and tab anchors 212 are snapped into place to secure the body 101. As shown in FIG. 10F, the end of headed set screw 124 is exposed through the slot opening 136 of mounted body 101, allowing a tool (for example a keyed hex wrench) to be used to loosen and tighten the set screw 124 and thereby adjust the axial location and angular position of the body 101 relative to support rod 110.

In some examples, the terms "substantially" and "approximately" mean within +/−20% of a value or references, unless the context indicates otherwise. Certain adaptations and modifications of the described embodiments can be made. Therefore, the above discussed embodiments are considered to be illustrative and not restrictive.

What is claimed is:

1. An anti-sweep mechanism for controlling removal of merchandise items from a forward dispensing end of a merchandise display rod, the anti-sweep mechanism comprising a body having a first blocking portion and a second blocking portion fixed in position relative to each other, the body being configured whereby when mounted to a support member adjacent the merchandise display rod the body is rotatable relative to an elongate axis of the merchandise display rod between a first position and a second position wherein:

when the body is in the first position, the first blocking portion blocks forward movement towards the forward dispensing end of merchandise items located on the merchandise display rod behind a first blocking location that is located behind the forward dispensing end, and the second blocking portion is rotated away from the merchandise display rod to not interfere with movement of merchandise items along the merchandise display rod;

when the body is in the second position, the first blocking portion is rotated away from the merchandise display rod to not interfere with movement of merchandise items along the merchandise display rod, and the second blocking portion blocks forward movement of merchandize items located on the merchandise display rod behind a second blocking location that is spaced behind the first blocking location.

2. The anti-sweep mechanism of claim 1 wherein the body is configured so that when the body is mounted to the support member and rotating between the first position and the second position at least one of the first blocking portion and the second blocking portion block forward movement of merchandize items along the merchandise display rod.

3. The anti-sweep mechanism of claim 1 comprising an anchor mechanism configured to retain the body at a desired location on the support member, the anchor mechanism configured to engage the support member to prevent axial sliding of the body relative to merchandise display rod.

4. The anti-sweep mechanism of claim 1 wherein the body defines an aperture configured to receive the support member and enable the body to rotate about the support member, and the body defines an internal cavity for the anchor mechanism.

5. The anti-sweep mechanism of claim 4 comprising a biasing mechanism rotationally biasing the body towards the first position.

6. The anti-sweep mechanism of claim 5, wherein the biasing mechanism comprises a spring received within the internal cavity and the anchor mechanism is configured to anchor a first portion of the spring to the support member.

7. The anti-sweep mechanism of claim 4 wherein the body includes a first body section and a second body section that each define respective portions of the aperture and the internal cavity, the first body section and the second body section configured to be secured together to mount the body on the support member.

8. The anti-sweep mechanism of claim 7 wherein the first body section and the second body section include cooperating tabs and tab anchors for securing the first body section and second body section together.

9. The anti-sweep mechanism of claim 4 wherein the anchor mechanism comprises: a nut having a slot for receiving a portion of the support member; and a set screw configured to engage threads of the nut and the support member to secure the anchor mechanism to the support member, wherein the nut is configured to restrain axial movement of the body along the support member by engaging walls of the body that define the internal cavity.

10. The anti-sweep mechanism of claim 9 wherein the body defines an opening that communicates with the internal cavity and through which a portion of the set screw extends, enabling the location of the body on support member to be adjusted without removing the body from the support member.

11. The anti-sweep mechanism of claim 9 wherein the body defines a first stop surface for engaging the set screw to prevent the body from rotating in a first direction beyond the first position and a second stop surface for engaging the set screw to prevent the body from rotating beyond the second position in an opposite direction.

12. The anti-sweep mechanism of claim 1 wherein the body includes a central portion defining an axial aperture configured to receive the support member, a first arm extending rigidly in a first radial direction from the central portion and forming the first blocking portion, and a second arm axially spaced from the first arm and extending rigidly in a different, second radial direction from the central portion and forming the second blocking portion.

13. The anti-sweep mechanism of claim 12 wherein the first arm has a hook-like profile and includes a section configured to extend under the merchandise display rod when the body is in the first position, and the second arm has a hook-like profile and includes a section configured to extend under the merchandise display rod when the body is in the second position.

14. The anti-sweep mechanism of claim 1 wherein the second blocking location is between ½ inch and 2 inches further from the dispensing end than the first blocking location, and the first and second blocking portions are each configured to radially extend to a maximum of between 1.5 and 3 inches from the support member.

15. A merchandise display hook system comprising:

a merchandise display rod and having a forward dispensing end for dispensing merchandise items;

a support rod;

the merchandise display rod and support rod mounted to a display fixture with the support rod extending substantially parallel to and spaced a predetermined distance from the merchandise display rod; and an anti-sweep mechanism for preventing sweeping of merchandise items from the dispensing end of the merchandise display rod, the anti-sweep mechanism comprising a body with a first blocking portion and a second blocking portion fixed relative to each other, the body being mounted to the support rod and rotatable about an elongate axis of the support rod between a first position and a second position, wherein:

the first blocking portion is configured to: (i) block forward movement of merchandise items suspended from the merchandise display rod behind a first blocking location when the body is in the first position or within a first angular range of the first position, and (ii) not block movement of merchandise items along the merchandise display rod when the body is in the second position or within a second angular range of the second position, wherein the first blocking position is located behind the forward dispensing end of the merchandise display rod;

the second blocking portion is configured to: (i) block forward movement of merchandise items suspended from the merchandise display rod behind a second blocking location that is located further from the dispensing end than the first blocking location, when the body is in the second position or within the second angular range, and (ii) not block movement of merchandise items along the merchandise display rod when the body is in the first position or within the first angular range;

the body being configured so that one or both of the first blocking portion and the second blocking portion will, when the body is rotated within an angular range that is between the first angular range and the second angular range, block movement of merchandise items along the merchandise display rod towards the dispensing end.

16. An anti-sweep mechanism for controlling removal of merchandise items from a merchandise display rod when the anti-sweep mechanism is mounted adjacent the merchandise display rod, the anti-sweep mechanism comprising:

a body configured to be rotatable about an axis between a first position and a second position, the body comprising:

a central portion through which the axis extends;

a first arm extending in a first radial direction from the central portion and forming a first blocking member;

a second arm extending in a second radial direction from the central portion and forming a second blocking member, the first arm and the second arm being fixed relative to each other;

the second arm being axially spaced apart on the central portion from the first arm;

wherein the body is configured so that, when the anti-sweep mechanism is mounted adjacent the merchandise display rod:

the first blocking portion will: (i) when the body is in the first position, block forward movement of merchandise items located on the merchandise display rod behind a first blocking location that is behind the forward dispensing end of the merchandise display rod, and (ii) when the body is in the second position, allow a merchandise item located forward of the first blocking location to be removed from a dispensing end of the merchandise display rod; and the second blocking portion will: (ii) when the body is in the second position, block forward movement of merchandise items located on the merchandise display rod behind a second blocking location that is located behind the first blocking location, and (ii) when the body is in the first position, allow a merchandise item to be moved along the merchandise display rod from behind the second blocking location to a position forward of the second blocking location.

17. The anti-sweep mechanism of claim 16 wherein the central portion defines an axial aperture for receiving a support rod to mount the anti-sweep mechanism adjacent the merchandise display rod, the anti-sweep mechanism comprising an anchor mechanism securable to the support rod to restrain axial movement of the body along the support rod.

18. The anti-sweep mechanism of claim 17 wherein the body defines an internal cavity within the central portion for the anchor mechanism.

19. The anti-sweep mechanism of claim 18 wherein the anchor mechanism comprises: a nut having a slot for receiving a portion of the support member; and a set screw configured to engage threads of the nut, and the support member, to secure the anchor mechanism to the support member.

20. The anti-sweep mechanism of claim 19 comprising a spring located within the internal cavity and having an end secured to the anchor mechanism, the spring biasing the body towards the first position.

* * * * *